US012241350B2

(12) United States Patent
Allen et al.

(10) Patent No.: US 12,241,350 B2
(45) Date of Patent: Mar. 4, 2025

(54) PHASE CONTROL FOR SUBTERRANEAN CARBON CAPTURE, UTILIZATION AND STORAGE

(71) Applicant: Halliburton Energy Services, Inc., Houston, TX (US)

(72) Inventors: Clifford Allen, Spring, TX (US); Bona Prakasa, Aberdeen (GB); Jonathon N. Joubran, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/981,260

(22) Filed: Nov. 4, 2022

(65) Prior Publication Data

US 2024/0068341 A1 Feb. 29, 2024

Related U.S. Application Data

(60) Provisional application No. 63/401,950, filed on Aug. 29, 2022.

(51) Int. Cl.
*E21B 43/16* (2006.01)
*E21B 43/14* (2006.01)

(52) U.S. Cl.
CPC ..... *E21B 43/164* (2013.01); *E21B 43/14* (2013.01); *E21B 2200/22* (2020.05)

(58) Field of Classification Search
CPC .... E21B 43/164; E21B 41/0064; E21B 34/06; E21B 43/16; E21B 43/12; E21B 43/26; E21B 43/2605; E21B 43/14; E21B 34/08; E21B 47/06; E21B 49/0875; E21B 49/08; E21B 43/166; E21B 49/00; E21B 2200/22
See application file for complete search history.

(56) References Cited

U.S. PATENT DOCUMENTS

| | | | |
|---|---|---|---|
| 9,816,353 | B2 | 11/2017 | Rashid et al. |
| 11,434,721 | B2 | 9/2022 | Joubran et al. |
| 2004/0200618 | A1 | 10/2004 | Piekenbrock |
| 2014/0345880 | A1 | 11/2014 | Enis et al. |
| 2015/0345259 | A1 | 12/2015 | Wang et al. |
| 2021/0140288 | A1* | 5/2021 | Lisk ..... E21B 34/16 |
| 2022/0220830 | A1 | 7/2022 | Kang et al. |

FOREIGN PATENT DOCUMENTS

| | | | |
|---|---|---|---|
| EP | 2631422 | A2 | 8/2013 |
| NO | 20220454 | A1 | 4/2022 |
| WO | 2020247709 | A1 | 12/2020 |

OTHER PUBLICATIONS

International Search Report and Written Opinion for International Patent Application No. PCT/US2022/050467 dated May 22, 2023. PDF file. 9 pages.

* cited by examiner

*Primary Examiner* — Zakiya W Bates
(74) *Attorney, Agent, or Firm* — Scott Richardson; C. Tumey Law Group PLLC

(57) ABSTRACT

Injection into a subterranean formation is optimized using a computation model to optimize injection. An optimization objective is to maximize the cumulative fluid mass rates injection that span over the remaining life of the field, while maintaining a dense or supercritical phase and operating within the equipment operational parameters. The phase at each location may be determined based on pressure and temperature, and flow is dynamically adjusted to maintain a phase having at least a threshold density of the carbon dioxide injected at each injection location.

20 Claims, 7 Drawing Sheets

| OBJECTIVE FUNCTION: | CONSTRAINTS: |
|---|---|
| $f(x_n y_{i,n}) = \sum_{t=1}^{T} M_t$ | $g(y_{i-i})$ = DENSE PHASE OR SUPERCRITICAL CONDITION<br>$h(y_{n-N})$= (T,P) ICV OPERATING CONSTRAINTS |

PHASE CONTROL FOR SUBTERRANEAN CARBON CAPTURE, UTILIZATION AND STORAGE

CROSS-REFERENCE TO RELATED APPLICATIONS

The present application is a non-provisional of U.S. Patent Application No. 63/401,950, filed on Aug. 29, 2022, the entire disclosure of which is incorporated herein by reference.

BACKGROUND

Naturally occurring, carbon-based fuels (sometimes referred to as "fossil fuels") are currently the most abundant, reliable, and cost-effective energy sources available to sustain the world's energy needs. Oil and natural gas are typically extracted from subterranean formations via hydrocarbon recovery wells created, operated, and managed by the oil and gas industry. Although oil and gas is among the most affordable energy source, extracting them entails tremendous expenditures of capital resources and development of technologies. Governmental regulations increase these costs. The industry, therefore, continuously seeks improvements on efficiency and maximization of assets. Hydrocarbon-bearing formations gradually become depleted over the course of many years. However, even depleted formations can be valuable assets in terms of their enormous storage capacity.

Certain groups have proposed theories and computer models purporting to demonstrate that emission of carbon dioxide ($CO_2$) has potential to affect climate over some period of time into the future. Carbon dioxide is generated and consumed by many of the Earth's natural processes, with some $CO_2$ being generated by carbon-based fuels. Although climate effects regarding $CO_2$ production remain somewhat speculative due to the fallibility of computer models and how they are interpreted, governmental bodies in the west have used these prognostications as a basis for regulating the industry based on $CO_2$ production and emissions. These regulations will further increase the cost of energy, which drives the need for greater efficiency and maximization of assets.

Permanent carbon storage technologies are one of a myriad of approaches being investigated as a way to comply with regulations and maximize utilization of assets. Soon, regulatory authorities around the world will require businesses to identify and implement decarbonization initiatives in the name of reducing global carbon emissions. The additional regulations may lead to a marketplace for permanent subterranean carbon storage using depleted formations. However, capturing and storing carbon compounds on a massive scale will require efficient automated mechanisms and technologies for carbon injection.

BRIEF DESCRIPTION OF THE DRAWINGS

These drawings illustrate certain aspects of some of the embodiments of the present disclosure and should not be used to limit or define the method.

DETAILED DESCRIPTION

The present disclosure relates to carbon capture, utilization, and storage (CCUS) using dynamic, real-time phase control of injected $CO_2$. A computation model is presented that may be combined with elements of formation characterization, monitoring technology, and smart well technology to maximize a cumulative mass flow of injected $CO_2$ using phase control. In examples below, injection valves used may be inflow control valves (ICVs). Pressure and temperature may be monitored at injection locations in the injection well while dynamically adjusting flow and pressure drops across each injection location to achieve a desired phase density of $CO_2$ on injection. The $CO_2$ is preferably injected in a supercritical or dense phase, while attempting to minimize gas and liquid phases at each injection location. In the supercritical and dense phases, $CO_2$ has a density approaching that of the liquid phase but with a viscosity and flowability similar to that of the gas phase. The transport of $CO_2$ is therefore far more efficient in the dense or supercritical phase than in the liquid or gaseous phase in terms of cost and throughput.

As discussed further below in example embodiments, an injection well can be divided into any number of sections of interest using a plurality of injection valves at different injection locations in a well. The $CO_2$ to be injected may be pumped downhole from a pressurized fluid source, e.g., using a pump at the surface of the well site. The pressurized $CO_2$ flows down the injection well through successive injection valves, while a portion of the flow is injected by each injection valve into the formation at the corresponding injection location. Pressure and temperature can be monitored downhole using pressure/temperature (P/T) gauges or fiber optics. A controller in communication with the injection valves and sensors has automated phase control logic for determining a phase of the carbon dioxide based on the pressure and temperature leading to the respective injection valves. The controller may dynamically adjust the flow at each injection location to maintain certain phase parameters such as a threshold density or threshold percentage of dense or supercritical flow of the carbon dioxide injected at each injection location. The controller may simultaneously enforce operational constraints (e.g., temperature and pressure limits or other specifications) of the injection valves. The controller may additionally control a pressure of the flow into the injection well from a pressurized fluid source, such as to compensate for changes in the pressure drops across one or more of the injection valves.

Figure 1:
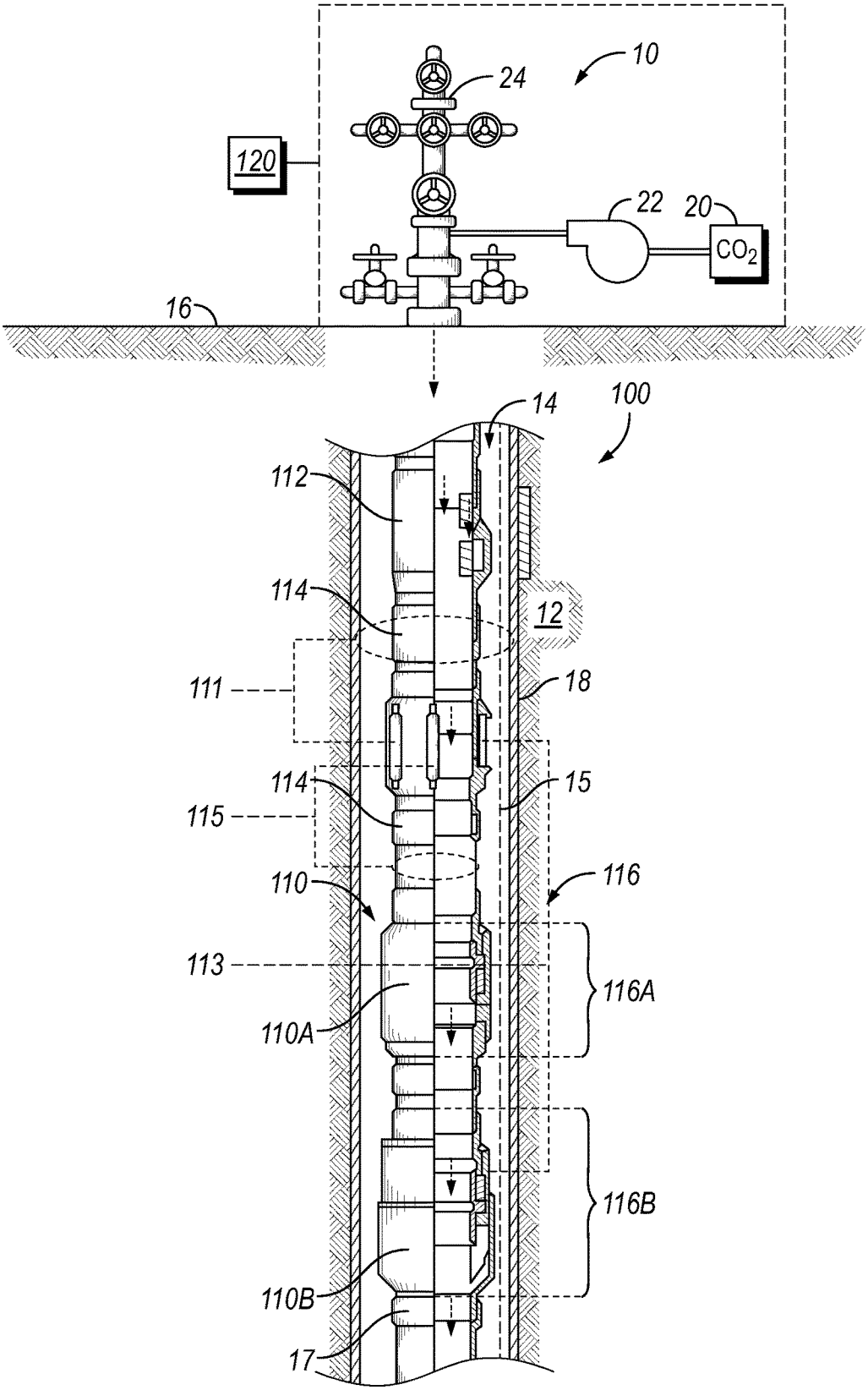
FIG. 1 is a representative diagram of a well site with an injection well according to aspects of this disclosure.

FIG. 1 is a representative diagram of a well site 10 with an injection well 14 according to aspects of this disclosure. The well site 10 is simplified for discussion purposes, and is not to scale. A single injection well 14 is shown but the well site 10 could include any number of wells adapted for $CO_2$ injection. The well site 10 is located above a large formation 12, which may have been producing oil and gas for many years until production was no longer economical. Alternatively, the well site 10 could be somewhere that oil and gas was not found in commercial quantities, but where storage in the formation 12 is otherwise viable. Thus, the injection well 14 may be an existing well adapted for $CO_2$ storage using the disclosed completions systems or a well drilled and completed specifically for injection. Although shown as vertical, directional drilling techniques may be applied such that the injection well 14 includes any number of horizontal, vertical, slant, curved, and other types of wellbore geometries and orientations.

Various equipment may be located at or above a surface 16 of the well site 10, i.e., surface equipment. The surface equipment has been schematically represented as a $CO_2$ source 20, a pump 22, and other pressure control equipment 24. The pressure control equipment 24 could include, for example, a surface wellhead or a system of valves and fluid connectors like a so-called Christmas tree. A surface reservoir cap 112 is provided to contain the well 14 and prevent leakage of injected fluids. The formation 12 that previously produced oil and gas now serves as a reservoir for the injected $CO_2$. The $CO_2$ source 20 may be any source of carbon dioxide, such as a $CO_2$ storage tank and/or a pipeline that transports $CO_2$ from another location at the well site 10 or from a remote location many miles/kilometers from the well site 10. The pump 22 may be used for pressurizing the $CO_2$, and the pump 22 and $CO_2$ source 20 may be collectively serve as a pressurized fluid source. The $CO_2$ source 20 and pump 22 may be connected to the injection well 14 via the pressure control equipment 24 to pump pressurized $CO_2$ downhole at a controllable pressure. The pressure control equipment 24 helps control the flow of fluids into the injection well 14 and preventing any unwanted flow of fluids out of the injection well 14.

A completions system 100 installed in the injection well 14 comprises structural components and controls below the surface 16. Some of the completions components may be components of a former production well, such as casing 18 that reinforces a portion of the injection well and some of the tubing 17 inside the casing 18, such as production tubing repurposed as injection tubing. The completions system 100 may include any number of injection valves 110 at respective injection locations 116 of the formation 12. Internal tubing 114 is provided to convey injected fluids from the reservoir cap 112 down to the injection valves 110. Pressure and temperature sensors may also be positioned at different locations, such as behind the casing reservoir cap 112, along the tubing 114, and at or near the injection valves 110. Any suitable pressure and temperature sensing equipment may be used, including but not limited to P/T gauges, fiberoptic sensor, and the like. An example of a tubing measurement region is generally indicated at 115.

The injection valves 110 are arranged in series at respective injection locations 116. Two injection valves 110 visible in FIG. 1 are an upper (shrouded) injection valve 110A and a lower (shrouded) injection valve 110B axially spaced below the upper injection valve 110A. Examples of shrouded ICV measurement regions are indicated at 111 and 113. Generally, each injection valve 110 controls a flow of the carbon dioxide (CO2) through the injection valve 110, injecting a portion of the flow into the formation 12 and passing the remainder of the flow to a next injection valve 110 in the series. Each injection valve 110 experiences a pressure drop related to its valve setting, which is controlled to achieve a desired injection density at that injection valve 110. Any number of additional injection valves (not shown) may be provided in series further down the injection well 14, to isolate the formation 12 into as many zones and injection locations as desired. The number of injection valves could also be increased to enhance granularity, such as to more finely control the placement of CO2 and the distribution thereof.

Any of a variety of valve types could be adapted for injection of $CO_2$. In examples below, the injection valves are inflow control valves (ICVs), which in a production well may be used to control flow from the formation into the injection well ("inflow"), but in the context of injection, may be adapted (e.g., used in reverse) for injection of $CO_2$ fluid from the injection well into the formation 12. An injection valve can have a variable flow restriction whose control can be automatically adjusted according to this disclosure. The variable flow restriction (i.e., amount of choke) may be continuously variable or have discrete positions corresponding to different flow areas of a through bore. In one example, each ICV may have 8 active positions. This leads to many possible different permutations of flow settings that must be managed by computer algorithm. Thus, assuming well operational parameters are defined a priori, the ICV position configuration problem concerning the establishment of optimized choke setting for each section can be automatically addressed for flow performance optimization over the time of interest. The algorithmically determined solution dictates the effective cross-sectional area (flow restriction or choke) of each ICV required to maintain efficient $CO_2$ injection. The effective flow area for each ICV is the quantity that is controlled for optimization purposes, which influences the density of injected $CO_2$.

A controller 120 is in communication with the surface equipment for controlling the flow of $CO_2$ into the injection well, and with the injection valves 110 to individually control flow through and injection of $CO_2$ at each injection valve 110. The controller 120 may include control components at surface 16 and/or downhole at one or more locations in the injection well 14. The completions system 100 may include features of formation characterization, monitoring, and/or smart well technology for communicating between components. For example, sensors and control elements may be embedded within or arranged externally to sections of the casing 18, including a communication network 15 providing electronic communication between the surface 16 and downhole locations. The controller 120 may thus comprise a central controller and/or a plurality of local controllers in communication with temperature sensors and/or pressure sensors in communication over the communication network 15 to control flow into the injection well 14 and at the injection locations 116.

Flow may be individually, dynamically adjusted at each injection valve to achieve a desired pressure and temperature combination. For example, the controller 120 may control pressure of the $CO_2$ pumped into the injection well 14 from the $CO_2$ source 20 and the pressure drops at the injection valves 110 to satisfy operational constraints and optimize phase of injected $CO_2$. Each injection valve has a controllable flow restriction, which may be continuously variable (i.e., infinite adjustment) or discrete settings. The pressurized $CO_2$ undergoes a pressure drop at each injection valve 110 corresponding in part to the degree of flow restriction. Thus, the flow restriction may be dynamically controlled to achieve the desired pressure and temperature corresponding to the desired phase characteristics of the injected flow as well as to satisfy operational constraints of the injection valves 110. The pressure of the flow into the injection well may also be controlled from surface to compensate for these pressure drops across the injection valves 110.

Figure 2:
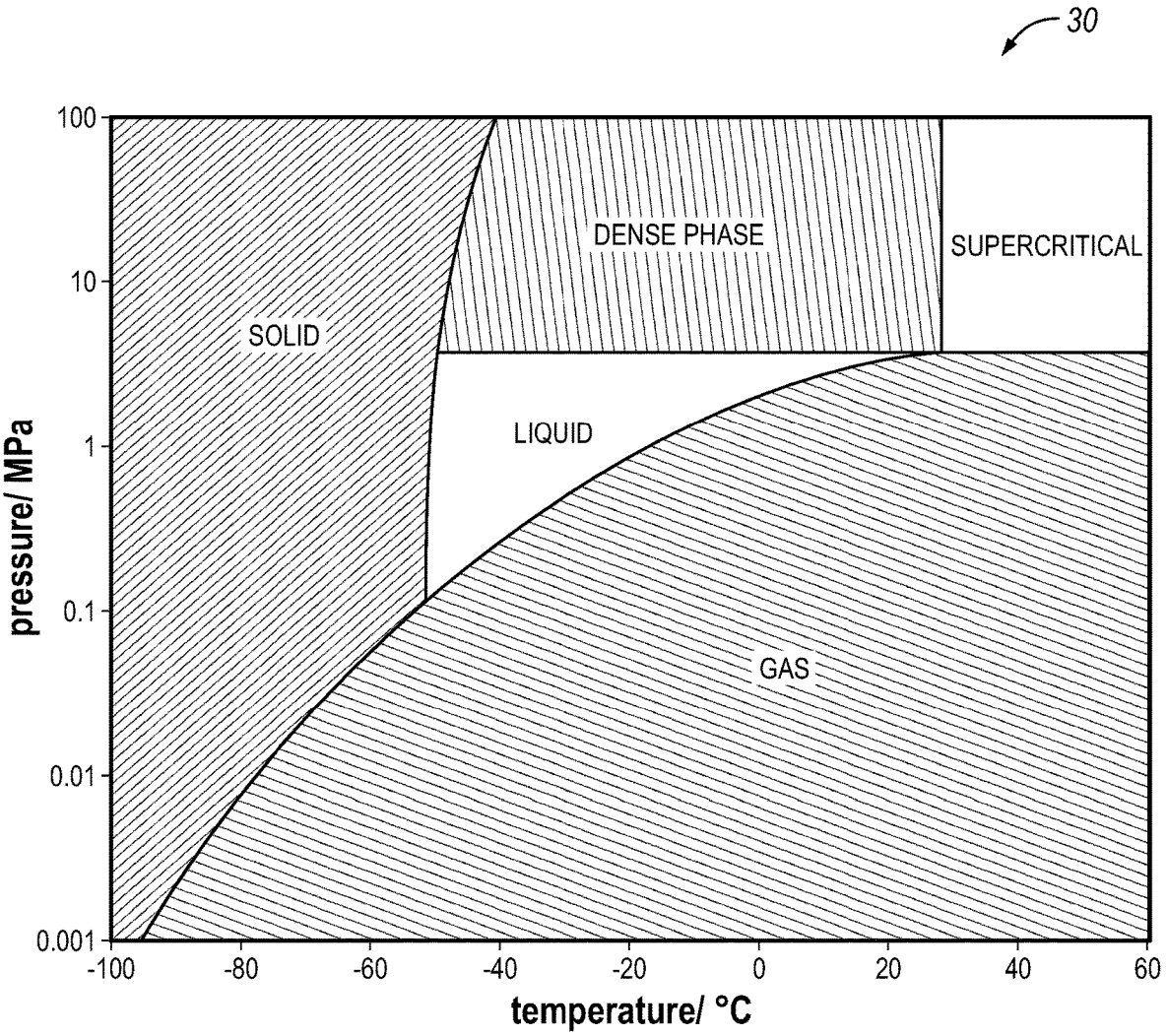
FIG. 2 is a representative phase diagram for $CO_2$ describing the relationship between temperature, pressure, and phase.

FIG. 2 is a representative phase diagram 30 for $CO_2$ describing the relationship between temperature, pressure, and phase. The disclosed systems and methods strive to maximize the efficiency of injection and a corresponding cumulative mass flow of injected $CO_2$ by controlling temperature and pressure to achieve a desirable phase at each injection location. The mass flow rate of injection depends on the density and flowability, which vary depending on the phases of $CO_2$ under different conditions of temperature and pressure. The solid phase is characterized by a high density with no flowability. The gas phase has high flowability but very low density. The liquid phase has a high density and some flowability, but a significant viscosity. The dense phase has a density comparable to liquid but with lower viscosity and higher flowability. The supercritical phase will generally have the most preferred phase for optimizing injection because it possesses both a density approaching that of liquid and a flowability and low viscosity approaching that of a gas. Thus, cumulative mass flow rate may be optimized by controlling temperature and pressure so that the injected $CO_2$ is predominantly in the dense or supercritical region.

Figures 3, 4:
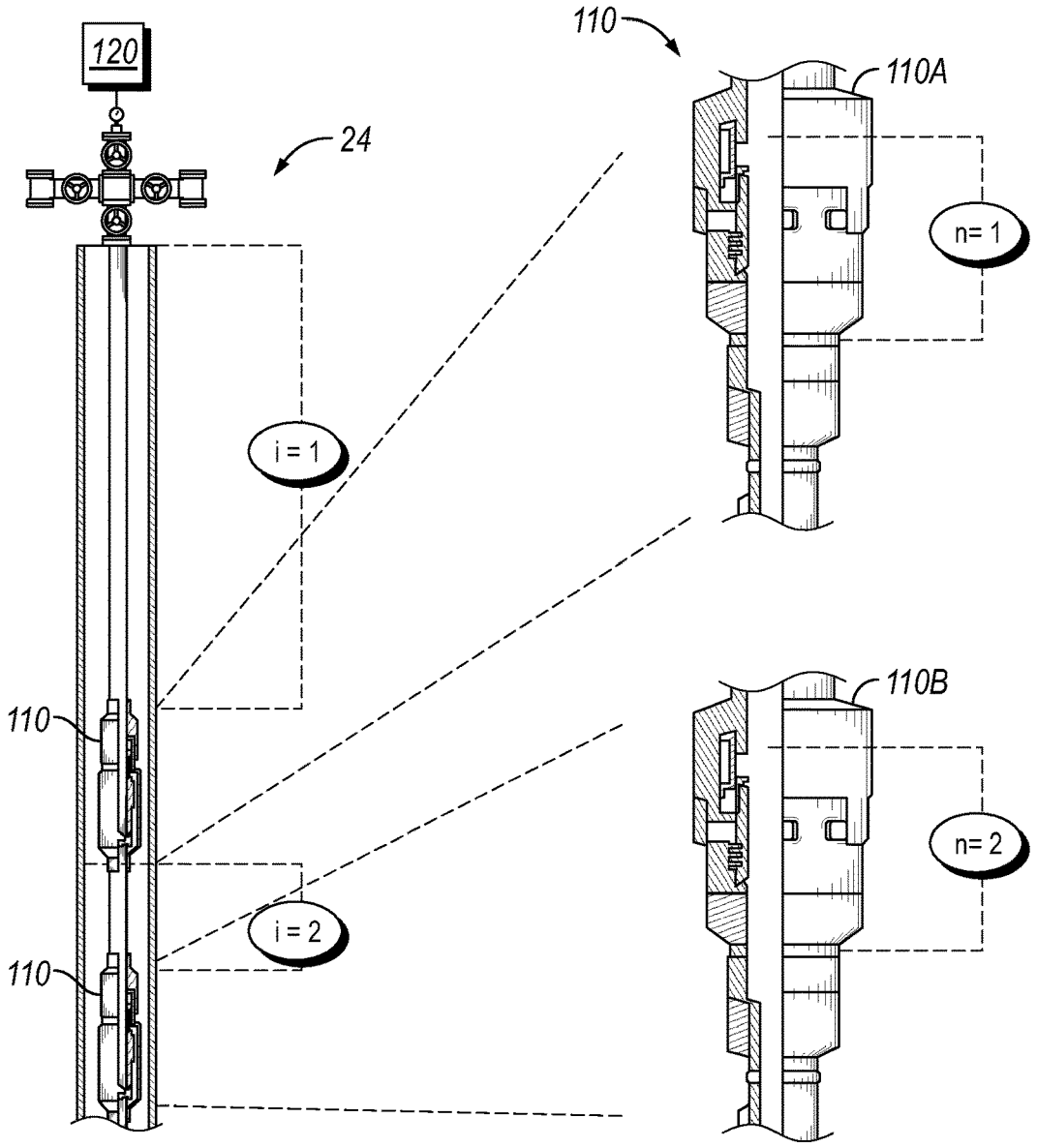
FIG. 3 is a schematic diagram of a computation model for controlling $CO_2$ injection in an injection well.
FIG. 4 is a table describing an objective function and constraints for the computation model.

FIG. 3 is a schematic diagram of a computation model for controlling $CO_2$ injection in an injection well such as the example in FIG. 1. Initially, a wellbore completions configuration can be divided into higher resolution or smaller sections of interest with placement of one or more injection valves (e.g., ICVs) 110 coupled with downhole pressure and temperature (P/T) monitoring sensors, e.g., gauges or fiberoptic sensor(s) at the inside and outside of a flow path defined by the ICV through bores and tubing leading to the ICVs. Considering that a $CO_2$ injection well may be equipped with a surface P/T gauge, the computation model may divide the $CO_2$ injection well into any number "I" of tubing sections and "N" ICVs. Each section of a flow path (e.g., tubing) leading to an ICV may be denominated as "i" for monitoring the pressure and temperature of flow to each ICV. Each ICV may be denominated as "n" for purpose of analyzing the pressure drops and outflow characteristics across each ICV. For example, a first tubing section between the surface P/T gauge and the first downhole ICV with P/T gauge that accounts for accelerations, hydrostatic and friction loss due to $CO_2$ injection can be denominated as i=1. The upper ICV section may be designated as n=1. The second tubing section between the first ICV and second ICV may be designated as i=2. The second ICV section can be designated n=2, and so on. The controller 120 may include control logic for implementing the computation model, thereby controlling the injection of $CO_2$.

Consequently, these sections are of interest for characterization of $CO_2$ flow behavior and pressure drop as pressures and temperatures are monitored, and automatically controlled. The optimization objective of the computation model is to establish ICV control settings that maximize the cumulative fluid mass rates injection that span over the remaining life of individual well or of a field of multiple wells. In examples, this is done, in part, by controlling pressure to maximize the dense or supercritical phase and minimize other phases such as gas and liquid. Since dense or supercritical phases are desired in this disclosure in part for their relative high density while maintaining flowability, the phase may be controlled in some embodiments to achieve at least a threshold density. The computation model may simultaneously maintain operational constraints such as to maintain each ICV within its operational constraints, such as temperature and pressure limits. This logic is embodied in the chart of FIG. 4.

FIG. 4 is a table describing an objective function "f" and constraints "g" and "h" for the computation model in one or more embodiments. In the objective function f, the parameter "x" may represent a vector of control parameters, which in the example of an 8-position ICV may comprise the eight positions. The parameter "y" may represent the state vector of the injected fluids for a different section (i,n) of the injection well. This state vector may comprise temperature and pressure leading to each respective ICV. Again, "n" denotes the index number of ICV sections and "i" represents the index number of the tubing sections being analyzed. The parameter "M" is the $CO_2$ mass injection rates discretized over well operational lifetime, which the computation model seeks to maximize. The parameter "t" may represent an individual simulation time step where T represents the total number of simulation steps. The first constraint (i.e., phase constraint) "g" relates to the requirement for a dense or supercritical phase at each section of tubing. The phase constraint may include additional specifics regarding the phase, such as a threshold density of the $CO_2$ phase injected or a threshold percentage of the $CO_2$ being dense or supercritical phase (minimizing other phases like gas or solid). The second constraint (operational constraint) "h" is to satisfy the operational constraints of the respective ICVs, such as temperature and pressure envelopes in compliance with the equipment ratings.

Figure 5:
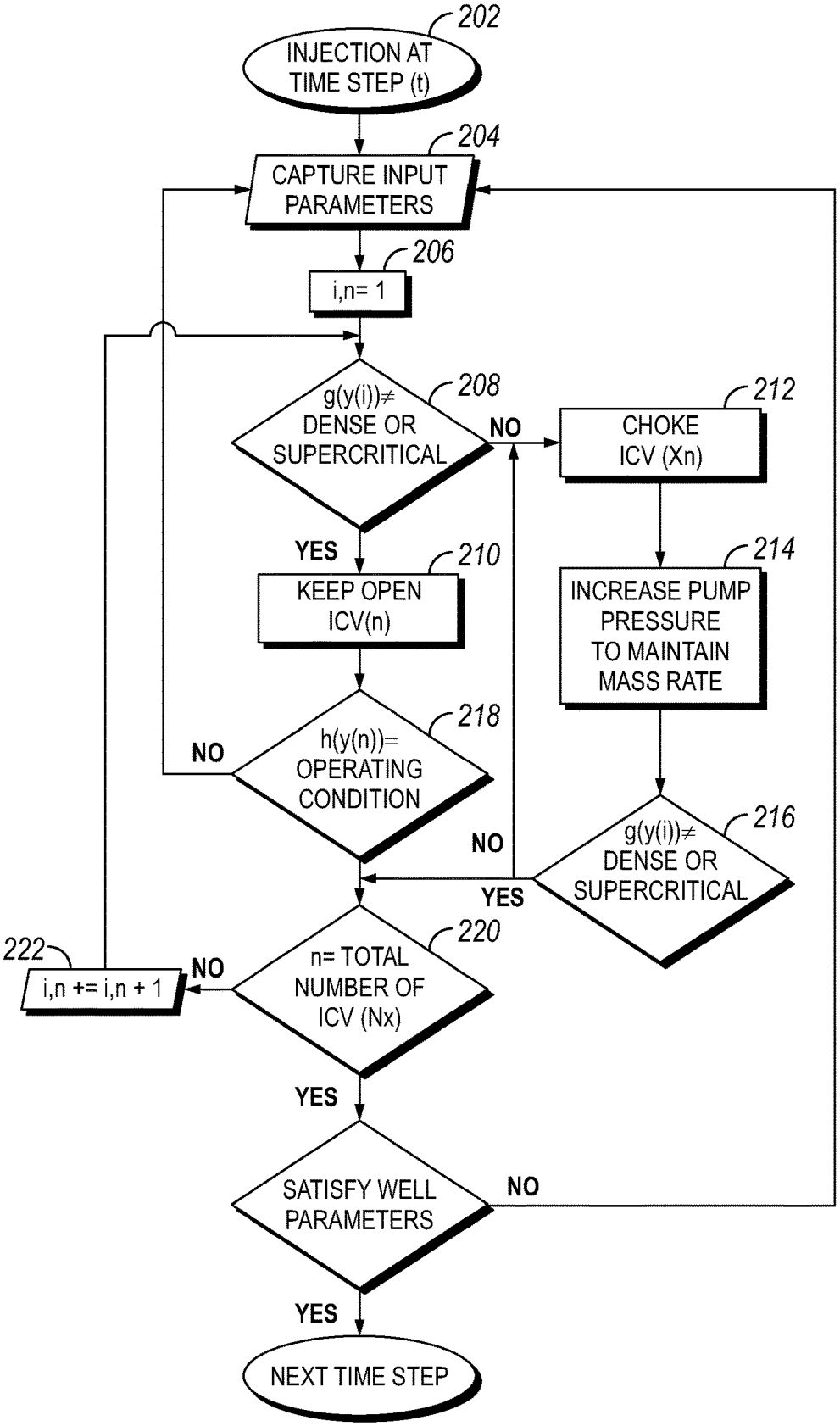
FIG. 5 is a flowchart generally outlining an optimization method implementing the computation model to satisfy the objective function and constraints of FIG. 4.

FIG. 5 is a flowchart generally outlining an optimization method implementing the computation model to satisfy the objective function and constraints of FIG. 4. The flowchart visually breaks the method down into certain example steps and a certain logical ordering of those steps for purpose of discussion. These steps may be implemented in an injection well as a control algorithm, embodied as control logic in the controller. However, one of ordinary skill in the art will appreciate that modifications to the flowchart may be made, such as steps added, certain steps moved or re-ordered, or variations in the specifics of how a step may be performed, and remain within the scope of this disclosure. As an overview, the method involves analyses that may be iteratively performed over consecutive time intervals, in one or more feedback loops, to dynamically update the ICV settings as needed to satisfy the objective function and constraints. At times, the injection well may reach quasi-steady-state, whereby no changes to ICV settings are required for a series of time intervals. At other times, various externalities may arise, such as the drilling of a nearby well, seismic activity, gradual changes in reservoir conditions, and so forth that may lead to a change in the ICV settings.

Injection is established per step 202, such as by initiating pressurized flow downhole to the ICVs. All ICVs may initially be open at the start of injection (t=0), while a maximum well head pump is established for pumping pressurized $CO_2$ downhole. Input parameters such as pressure and temperature are captured according to step 204, such as using P/T gauges, fiber sensors, or the like. Each time period may serve as an optimization period whereby ICV settings are selected for a subsequent time interval in satisfaction of the objective function and constraints. For example, the optimization period may entail performing an optimization search to find and compare one or more combination of ICV settings that are expected to satisfy the objective function and constraints. Flow at the ICVs may be individually analyzed in terms of temperature, flow rate, and pressure drop in view of the current ICV setting. For discussion purposes, the flowchart illustrates this analysis as though performed sequentially for a total of I tubing segments and N ICVs, starting from i=1, n=1 at step 206. However, the analysis for these tubing segments and ICVs could be performed in parallel or in another order during the optimization period.

A first feedback loop is outlined comprising steps 208 to 216, whereby the first (phase) constraint "$g(y_{i-I})$=dense or supercritical phase" is to be satisfied (see FIG. 4). Decisional step 208 is to evaluate whether the flow at tubing segment "I" leading to ICV "n" is under dense phase or supercritical condition to satisfy the constraint (FIG. 4) wherein $g(y_{i-I})$= dense or supercritical phase. If so, that ICV(n) may be held open per step 210 without adjustment. If not, a feedback loop evaluates the result of adjusting flow at the ICV in response to the fluid condition of observed tubing section (i) leading up to that ICV. As part of that feedback loop, step 212 chokes (i.e., increases the flow restriction) at the ICV to increase the pressure drop across that ICV. Surface pump pressure is increased per step 214 to compensate for the increased pressure drop at the ICV, thereby maintaining the mass flow rate. If the constraint is not met at decisional step 216, i.e., $g(y_{i-I})\neq$ dense or supercritical phase, the system may return to step 212 to further reduce flow to ICV(n) in order to increase the pressure within the tubing section (i) that leads to that ICV.

A second feedback loop is also outlined in the flowchart whereby the second (operational) constraint "h" is to be satisfied (see FIG. 4). Per decisional step 218, the logic may measure whether the fluid is operating within the operational parameters, such as recommended temperature and pressure envelopes of the equipment, i.e., $h(y_{n-N})$=ICV operating constraints (T, P). An example of when operational constraints are not satisfied is when the pressure drop across an ICV or the temperature drop as a consequence of the Joule-Thompson effect result in a T and/or P outside the ICV's ratings. If the operational parameters for the ICV are not met, the control logic may return to the first feedback loop outlined in steps 208 to 216 to identify a different set of ICV setting(s) that satisfy the first constraint g (phase) and return to step 218 to check if they also satisfy the second constraint h (ICV operational parameters). The injection parameters such as mass rate may also be evaluated and possibly reduced if needed to satisfy both constraints.

These feedback loops to satisfy the first constraint g (phase) and second constraint h (operational parameters) could be performed on the actual completions system of the injection well, or as part of a simulation, or a combination of both. For example, the feedback loops may be at least partially implemented on the actual system, whereby changes are iteratively made to the ICVs in the system and the effect on pressure and other effects are measured in the system using the P/T gauges or other sensors, in order to decide on further adjustments. However, iteratively performing such changes directly to the system may introduce some lag, particularly before the system has yet achieved a quasi-steady-state. Alternatively, therefore, the feedback loops may be first performed by simulation during the current optimization period before actually making changes to the ICV flow settings. That is, the completions system including the N valves, I tubing segments, pump pressure, and so forth, may be modeled. The analysis may be performed using the model and a desired solution found before the next time interval is reached. The changes to ICV settings and pump pressure as determined by simulation may then be implemented on the actual system upon reaching the next time interval (t+1), which serves as the new optimization period a new set of solutions proposed at a further time interval (t+2), and so on. If the measured results in the actual system do not fully conform to the results of the simulation, the feedback loops may be used to make further changes directly to the actual system or by first proposing a new set of solutions by simulation to be implemented on the actual system.

As outlined, the cycle will be performed for each ICVs installed in the injection well, before repeating for the next simulation time cycle. Thus, decisional step 220 checks for additional ICVs that need to be analyzed, and if so, i and n are incremented per step 222. The cycle will regress the injection parameters to ultimately maximize the objective function. These may be determined by use of the gradient-based optimization method and the base-case reservoir model.

Figure 6:
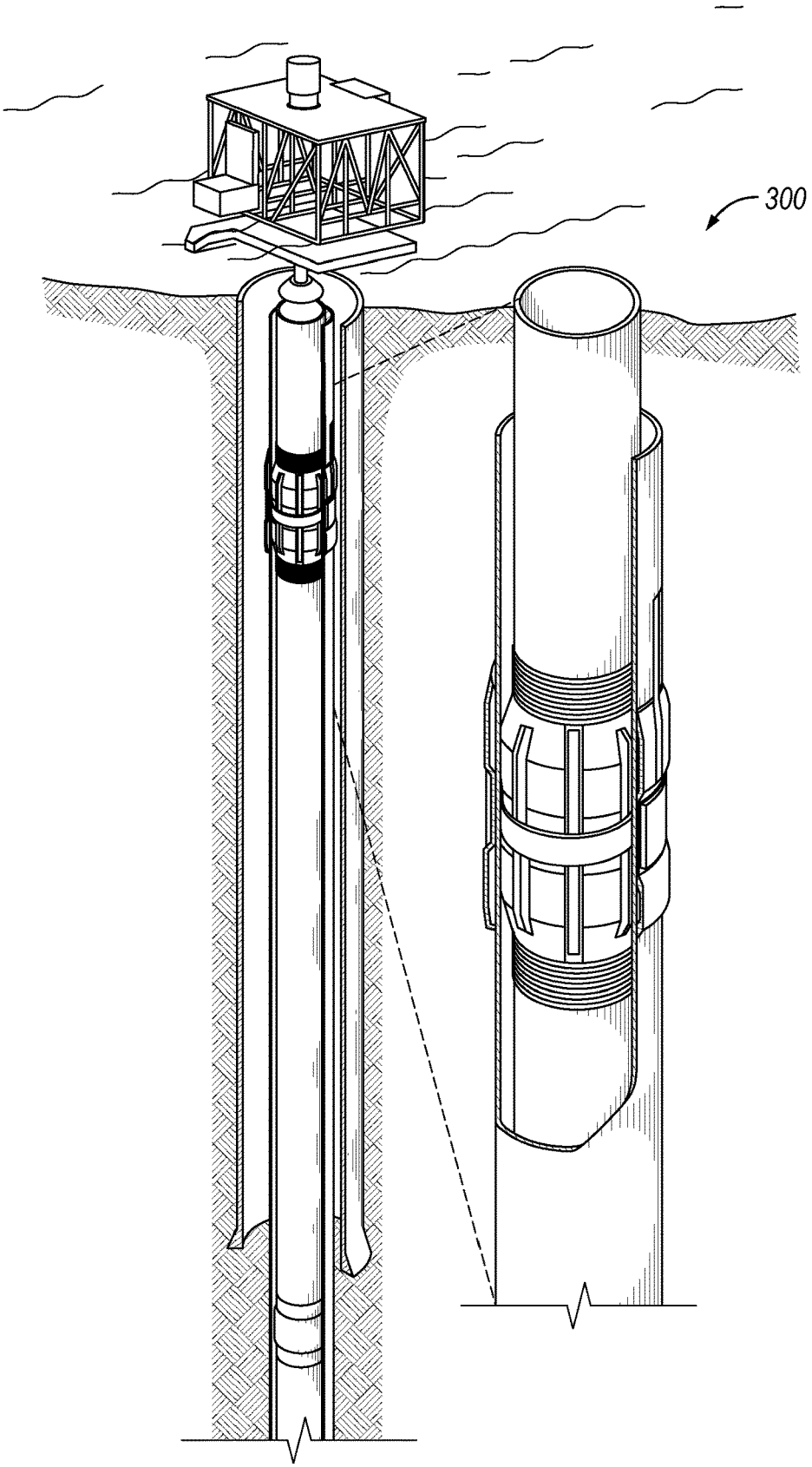
FIG. 6 is an elevation diagram of an additional monitoring system that can be deployed behind casing and ultimately across the sand face.
Figure 7:
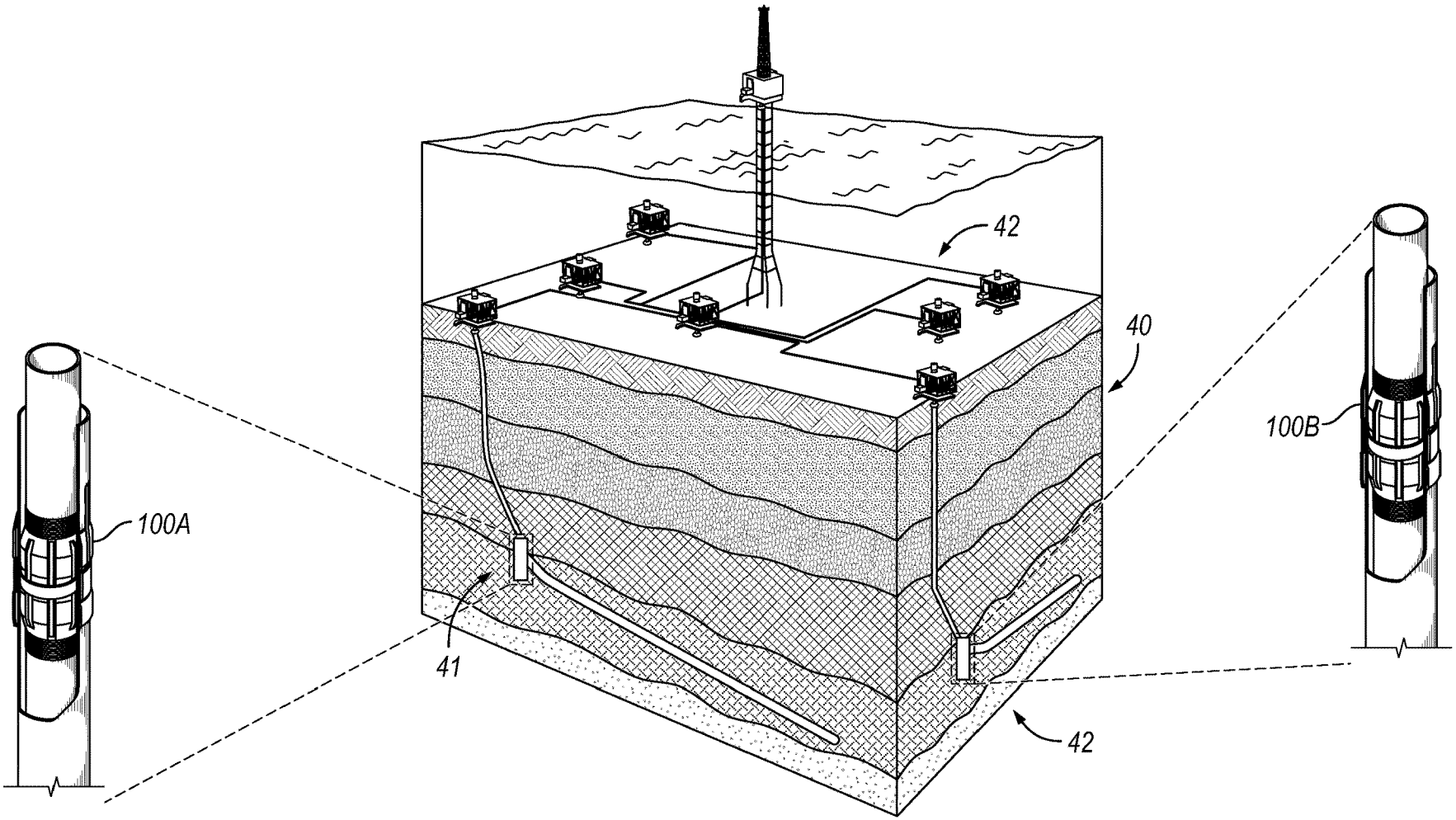
FIG. 7 is a conceptual view of a large injection reservoir that may be serviced by multiple injection wells.
Figure 8:
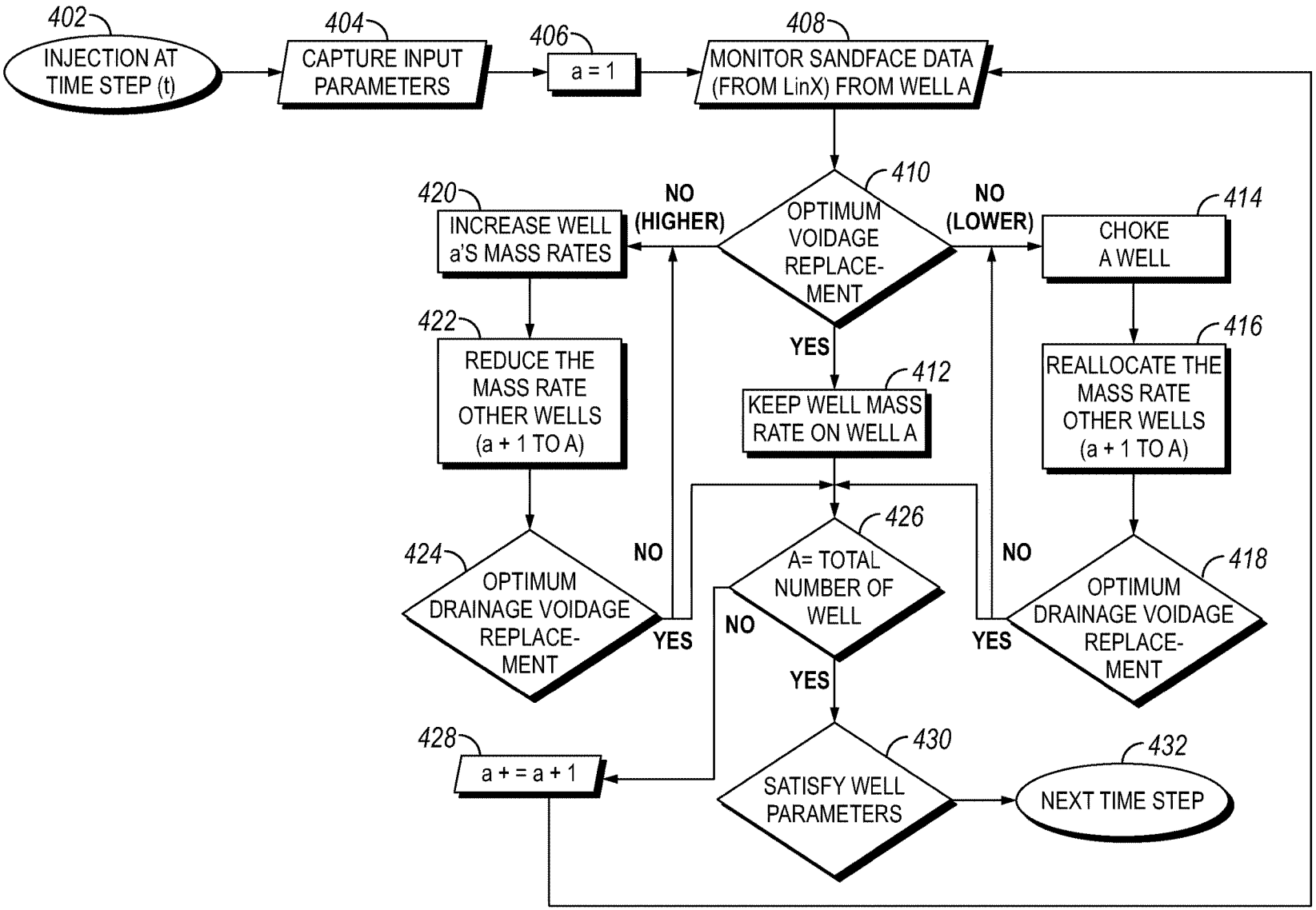
FIG. 8 is a flowchart generally outlining an optimization method for injection in a field of multiple injection wells such as depicted in FIG. 7.

FIG. 6-8 present an alternate embodiment wherein multiple injection wells in a field may be operated concurrently to satisfy operational constraints not only of each well (as discussed per FIGS. 1 to 5) but also collective field constraints or goals for the multiple injection wells. For example, mass flow rates at each well may be adjusted to balance storage of $CO_2$ throughout the field.

FIG. 6 is an elevation diagram of an additional monitoring system 300 that can be deployed behind casing and ultimately across the sand face. Quartz-based permanent downhole gauges may be provided by way of example and not by limitation using a package such as LinX® (a registered trademark of Halliburton AS). The LinX monitoring system is a wireless through-wellbore technology that enables the placement of a permanent pressure/temperature gauge behind the production casing. Using this system will allow for reading an accurate pressure and temperature of target reservoir. Hence the quality of the $CO_2$ injection can be evaluated. The LinX® system may provide accurate, continuous data from behind the casing, by enabling wireless through-casing power and communication. The top of the reservoir comprises a seal that prevents gas from going through surface.

FIG. 7 is a conceptual view of a large injection reservoir 40 that may be serviced by multiple injection wells 100 distributed throughout a field 42. Two injection wells 100A, 100B are identified by way of example although in a CCUS scenario, networks comprising any number of $CO_2$ injector wells are simultaneously injected into the same reservoir in order to ensure maximum number of carbon is being stored underground. The nature of the reservoir 40 is heterogenous where different location of injection, e.g., 41 and 42, are populated with unique geology and characteristics. For example, as depicted in FIG. 7, the first injection well 100A that is being injected at the flank region, South-West of the reservoir 40, will have a different permeability, porosity and local drainage (or voidage) replacement volume. Meanwhile the second injection well 100B that is injected in a different region of reservoir, e.g., at the North-East of the reservoir, the geology is populated with different geometry and reservoir permeability and other properties. Consequently, each injection well 100A, 100B would have a different well performance and different voidage replacement efficiency. Optimizing the network performance is thus relying on the effect of individual $CO_2$ injection well against their respected injection drainage which can be evaluated through the sandface data, or LinX data, that is installed in the same well completion string. Such measured sandface's pressure and temperature data is correlated with injection performance and voidage replacement strategy.

A closed-loop feedback workflow is developed between LinX reading and well head injection volume control. The monitored data from LinX will play its role as feedback to the logic whether the well injection strategy is in optimum voidage replacement. The logic would evaluate whether the injection mass rate is appropriate or need to be increased and perhaps in some other cases reallocated to other wells. For example, consider a CCUS project is bounded by contract to inject by 10 M ton of $CO_2$ per year (or 287 Kg/s), and the project will drill 5 $CO_2$ wells to achieve this target. Initially, the injection wells were designed such each will equally contribute to the total injection mass rate, i.e., each well will inject around 57 Kg/s. With time, the information from each injection well would enable update of geologic and or reservoir properties as well as the voidage replacement areas of each well. Given the update, the logic would evaluate whether the injection of well is allocated appropriately or adjustment or reallocation of well rates is needed. In this scenario, if one of the sandface measurement from LinX is indicating a rapid increase of the reservoir pressure, this may imply that storage for that well is smaller than what is initially thought).

FIG. 8 is a flowchart generally outlining an optimization method for injection in a field of multiple injection wells such as depicted in FIG. 7. Each injection well may be individually managed according to the systems and methods of FIGS. 1 to 5, while the optimization method of FIG. 8 manages the field as a whole. The flowchart logic starts at evaluating the performance of a well "a" at time step (t), at step 402. Input parameters are captured at step 404. The analysis starts with a first well (a=1) per step 406. Sandface data is monitored (e.g., using LinX) at the current well under evaluation per step 408. Decisional step 410 evaluates optimal voidage replacement. If optimal, the current mass rate is maintained at that well per step 412. Alternatively, if well "a" injection is at constraint limits and needs to be restrained to preserve reservoir integrity, then the logic may entail choking the injection well (step 414) and reallocating injection rates to other wells (step 416) from well a+1 to the total number of wells, A. If well a is instead assessed to be far from constraint limits and lower than optimum, then injection for well a can be increased (step 420) and/or injection rate can be reduced for other wells (step 422). Hence, the incremental rates of well a, results in reduced rates for other wells (well a+1 to well A) per step 422. In either case, optimum drainage voidage replacement is evaluated per step 418 or 424, respectively. The logic would loop for the next well until total number of wells has been evaluated per decisional step 426 and incremental step 428 and flow rates adjusted. Once all well parameters have been satisfied for the current time period (decisional step 430) the analysis may advance to the next time step (e.g., file optimization period) per step 432.

Accordingly, the present disclosure may provide systems and methods for $CO_2$ injection that optimize mass flow rates by maintaining dense or supercritical flow at each injection location. The systems and methods may include any suitable combination of the various features disclosed herein, including one or more of the following examples.

Example 1

An injection system, comprising: a plurality of injection valves arranged at different injection locations in an injection well in a subterranean formation, each injection valve configured for controlling a flow of carbon dioxide and a corresponding pressure drop through the valve and injecting some of the flow into the subterranean formation; one or more sensors to sense pressure and temperature of the flow leading to each injection valve; and a controller in communication with the injection valves and having control logic for determining a phase of the carbon dioxide based on the pressure and temperature leading to the respective injection valves and dynamically adjusting the flow at each injection valve based on the phase to maintain at least a threshold density of the carbon dioxide injected at each injection location.

Example 2

The injection system of Example 1, wherein the controller dynamically adjusts the flow through each injection valve based on the phase of the carbon dioxide to maintain a supercritical phase of the carbon dioxide injected into the subterranean formation at each injection location.

Example 3

The injection system of any of Examples 1 or 2, further comprising a controllable pressure source for the flow of carbon dioxide into the injection well, wherein the controller dynamically adjusts the pressure of the flow from the pressure source into the injection well in relation to the pressure drops through the injection valves.

Example 4

The injection system of any of Examples 1-3, wherein each injection valve comprises operating constraints comprising one or both of a temperature constraint and a pressure constraint, wherein the controller dynamically adjusts the flow at each injection valve within a setting range that maintains at least the threshold density of the carbon dioxide injected at each injection location while also complying with the operating constraints of the injection valves.

Example 5

The injection system of any of Examples 1-4, wherein the controller automatically adjusts the injection valves to maximize a cumulative fluid mass rate injection while maintaining at least some threshold percentage of the carbon dioxide at the injection locations in a dense or supercritical phase.

Example 6

The injection system of any of Examples 1-5, wherein the control logic operates over a series of time intervals, iteratively maintaining a flow rate for a current time interval while performing an optimization search for a next time interval comprising the step of determining the phase of the carbon dioxide based on the pressure and temperature leading to the respective injection valves for the next time interval, and at the next time interval, performs the step of dynamically adjusting the flow to maintain at least the threshold density of the carbon dioxide injected at each injection location.

Example 7

The injection system of Example 6, wherein for each optimization search the controller performs a simulation to identify and compare possible combinations of settings for the injection valves and implements a selected one of the possible combinations of settings on a subsequent time interval.

Example 8

The injection system of Example 6 or 7, wherein for each optimization search the controller iteratively selects and implements a combination of settings directly in the injection system, determines the phase of the carbon dioxide based on the pressure and temperature leading to the respective injection valves after implementing the combination of settings, and further adjusts the flow at each injection valve if phase constraint have not been met.

Example 9

The injection system of any of Examples 1-8, further comprising:

a second injection well operated in parallel with the injection well, wherein the controller further comprises control logic for dynamically adjusting a mass flow rate to each of the injection well and the second injection well.

Example 10

The injection system of Example 9, wherein the one or more sensors further comprise wireless pressure and/or temperature gauges behind a production casing.

Example 11

A method, comprising: injecting carbon dioxide at different injection locations in an injection well in a subterranean formation, while controlling a flow of carbon dioxide and a corresponding pressure drop at each injection location; sensing pressure and temperature of the flow leading to each injection location; determining a phase of the carbon dioxide based on the pressure and temperature leading to the respective injection locations; and dynamically adjusting the flow at each injection location based on the phase to maintain at least a threshold density of the carbon dioxide injected at each injection location.

Example 12

The method of Example 11, further comprising dynamically adjusting the flow at each injection location based on the phase of the carbon dioxide to maintain a supercritical phase of the carbon dioxide injected into the subterranean formation at each injection location.

Example 13

The method of Example 11 or 12, further comprising dynamically adjusting a pressure of flow into the injection well in relation to the pressure drops through the injection valves.

Example 14

The method of any of Examples 11-13, further comprising dynamically adjusting the flow at each injection location within a setting range that maintains at least the threshold density of the carbon dioxide injected at each injection location while also complying with operating constraints of injection valves used for injecting.

Example 15

The method of any of Examples 11-14, further comprising automatically adjusting the flow at the injection locations to maximize a cumulative fluid mass rate injection while maintaining at least some threshold percentage of the carbon dioxide at the injection locations in a dense or supercritical phase.

Example 16

The method of any of Examples 11-15, further comprising iteratively maintaining a flow rate at each injection location for a current time interval while performing an optimization search for a next time interval comprising determining the phase of the carbon dioxide based on the pressure and temperature leading to the respective injection locations for the next time interval, and at the next time interval, dynamically adjusting the flow to maintain at least the threshold density of the carbon dioxide injected at each injection location.

Example 17

The method of Example 16, further comprising for each optimization search performing a simulation to identify and compare possible combinations of settings for the injection valves and implementing a selected one of the possible combinations of settings on a subsequent time interval.

Example 18

The method of Example 16 or 17, further comprising: for each optimization search iteratively selecting and implements a combination of settings directly in the system; determining the phase of the carbon dioxide based on the pressure and temperature leading to the respective injection locations after implementing the combination of settings; and further adjusting the flow at each injection location if phase constraint have not been met.

Example 19

The method of any of Examples 11-18, further comprising: operating a second injection well in parallel with the injection well, wherein the method further comprises dynamically adjusting a mass flow rate to each of the injection well and the second injection well.

Example 20

The method of Example 19, further comprising transmitting the pressure and/or temperature wirelessly from behind a production casing.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein.

Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. An injection system, comprising:

a plurality of injection valves arranged at different injection locations in an injection well in a subterranean formation, each injection valve configured for controlling a flow of carbon dioxide and a corresponding pressure drop through the valve and injecting some of the flow into the subterranean formation;

one or more sensors to sense pressure and temperature of the flow leading to each injection valve; and a controller in communication with the injection valves and configured having control logic to determine a phase of the carbon dioxide based on the pressure and temperature leading to the respective injection valves and to dynamically adjust the flow at each injection valve based on the phase as determined by the controller to maintain at least a threshold density of the carbon dioxide injected at each injection location.

2. The injection system of claim 1, wherein the controller is configured via the control logic to dynamically adjust the flow through each injection valve based on the phase of the carbon dioxide as determined by the controller to maintain a supercritical phase of the carbon dioxide injected into the subterranean formation at each injection location.

3. The injection system of claim 1, further comprising a controllable pressure source for the flow of carbon dioxide into the injection well, wherein the controller is configured via the control logic to dynamically adjust the pressure of the flow from the pressure source into the injection well in relation to the pressure drops through the injection valves.

4. The injection system of claim 1, wherein each injection valve comprises operating constraints comprising one or both of a temperature constraint and a pressure constraint, wherein the controller is configured via the control logic to dynamically adjust the flow at each injection valve within a setting range that maintains at least the threshold density of the carbon dioxide injected at each injection location while also complying with the operating constraints of the injection valves.

5. The injection system of claim 1, wherein the controller is configured via the control logic to automatically adjust the injection valves to increase a cumulative fluid mass rate injection while maintaining at least some threshold percentage of the carbon dioxide at the injection locations in a dense or supercritical phase.

6. The injection system of claim 1, wherein the control logic operates over a series of time intervals, iteratively maintaining a flow rate for a current time interval while performing an optimization search for a next time interval comprising the step of determining the phase of the carbon dioxide based on the pressure and temperature leading to the respective injection valves for the next time interval, and at the next time interval, performs the step of dynamically adjusting the flow to maintain at least the threshold density of the carbon dioxide injected at each injection location.

7. The injection system of claim 6, wherein for each optimization search the controller is configured via the control logic to perform a simulation to identify and compare possible combinations of settings for the injection valves and implement a selected one of the possible combinations of settings on a subsequent time interval.

8. The injection system of claim 6, wherein for each optimization search the controller is configured via the control logic to iteratively select and implement a combination of settings directly in the injection system, determine the phase of the carbon dioxide based on the pressure and temperature leading to the respective injection valves after implementing the combination of settings, and further adjust the flow at each injection valve if phase constraints have not been met.

9. The injection system of claim 1, further comprising:

a second injection well operated in parallel with the injection well, wherein the controller further comprises control logic for dynamically adjusting a mass flow rate to each of the injection well and the second injection well.

10. The injection system of claim 9, wherein the one or more sensors further comprise wireless pressure and/or temperature gauges behind a production casing.

11. An injection system, comprising:

injection valves arranged at different injection locations, respectively, in an injection well in a subterranean formation, each injection valve configured to control a flow of carbon dioxide and a corresponding pressure drop through the valve and to inject some of the flow into the subterranean formation;

one or more sensors to sense pressure and temperature of the flow leading to each injection valve; and a controller in communication with the injection valves and having control logic to determine a phase of the carbon dioxide based on the pressure and the temperature and dynamically adjust the flow at each injection valve based on the phase to maintain at least a threshold density of the carbon dioxide injected at each injection location of the different injection locations, wherein the controller dynamically adjusts the flow through each injection valve based on the phase of the carbon dioxide as determined by the controller to maintain a dense phase or a supercritical phase of the carbon dioxide injected into the subterranean formation at each injection location.

12. The injection system of claim 11, further comprising a source of the carbon dioxide having controllable pressure for the flow of the carbon dioxide into the injection well, wherein the controller is configured to adjust the pressure of the flow from the source into the injection well, and wherein the controller is configured to dynamically adjust the flow through each injection valve based on the phase of the carbon dioxide to maintain the dense phase or the supercritical phase of the carbon dioxide injected into the subterranean formation at each injection location.

13. The injection system of claim 12, wherein the source comprises a tank or a pipeline.

14. The injection system of claim 11, wherein the controller automatically adjusts the injection valves to increase a cumulative fluid mass rate injection while maintaining a threshold percentage of the carbon dioxide at the injection locations in the dense phase or the supercritical phase.

15. The injection system of claim 11, wherein the control logic operates over a series of time intervals, iteratively maintaining a flow rate for a current time interval while performing a search for a next time interval comprising the determining the phase of the carbon dioxide based on the pressure and the temperature for the next time interval, and at the next time interval, performs the dynamically adjusting the flow to maintain at least the threshold density of the carbon dioxide injected at each injection location.

16. The injection system of claim 15, wherein for each search the controller performs a simulation to identify and compare combinations of settings for the injection valves and implements a selected one of the combinations of settings on a subsequent time interval.

17. The injection system of claim 15, wherein for each search the controller iteratively selects and implements a combination of settings directly in the injection system, determines the phase of the carbon dioxide based on the pressure and the temperature after implementing the combination of settings, and further adjusts the flow at each injection valve if phase constraints have not been met.

18. An injection system, comprising:

a plurality of injection valves arranged at different injection locations in an injection well in a subterranean formation, each injection valve configured for controlling a flow of carbon dioxide and a corresponding pressure drop through the valve and injecting some of the flow into the subterranean formation;

a controllable pressure source of the carbon dioxide for the flow of carbon dioxide into the injection well;

one or more sensors to sense pressure and temperature of the flow leading to each injection valve; and a controller in communication with the injection valves and having control logic for determining a phase of the carbon dioxide based on the pressure and temperature leading to the respective injection valves and dynamically adjusting the flow at each injection valve based on the phase to maintain at least a threshold density of the carbon dioxide injected at each injection location.

19. The injection system of claim 18, wherein the controller is configured to dynamically adjust the pressure of the flow of the carbon dioxide from the controllable pressure source into the injection well, and wherein the controller is configured to dynamically adjust the flow through each injection valve based on the phase of the carbon dioxide to maintain the dense phase or the supercritical phase of the carbon dioxide injected into the subterranean formation at each injection location.

20. The injection system of claim 18, wherein the controller automatically adjusts the injection valves to increase a cumulative fluid mass rate injection while maintaining a threshold percentage of the carbon dioxide at the injection locations in the dense phase or the supercritical phase.

* * * * *